US008192216B1

(12) United States Patent
Puluc et al.

(10) Patent No.: US 8,192,216 B1
(45) Date of Patent: Jun. 5, 2012

(54) ELECTRICAL CONNECTOR WITH MOISTURE RESISTANT SEAL

(75) Inventors: Oscar A. Puluc, Downey, CA (US); Zhimin Guo, Cerritos, CA (US); Thomas D. Peterson, Covina, CA (US)

(73) Assignee: R.A. Phillips Industries, Inc., Santa Fe Springs, CA (US)

( * ) Notice: Subject to any disclaimer, the term of this patent is extended or adjusted under 35 U.S.C. 154(b) by 0 days.

(21) Appl. No.: 13/022,629

(22) Filed: Feb. 7, 2011

(51) Int. Cl.
*H01R 4/00* (2006.01)

(52) U.S. Cl. ..... 439/271; 439/680

(58) Field of Classification Search ..... 439/271, 439/272, 680
See application file for complete search history.

(56) References Cited

U.S. PATENT DOCUMENTS

| | | | | |
|---|---|---|---|---|
| 4,637,674 | A * | 1/1987 | Kobler | 439/371 |
| 5,263,873 | A * | 11/1993 | Landries | 439/271 |
| 5,803,759 | A * | 9/1998 | Griffith et al. | 439/274 |
| 6,244,886 | B1 * | 6/2001 | Strang et al. | 439/271 |
| 6,290,537 | B1 * | 9/2001 | Sommer | 439/559 |
| 6,786,768 | B2 * | 9/2004 | Murakami | 439/595 |
| 7,309,247 | B1 * | 12/2007 | Keating | 439/271 |
| 2002/0076965 | A1 * | 6/2002 | Lux et al. | 439/271 |
| 2006/0270262 | A1 * | 11/2006 | Schmidt et al. | 439/271 |
| 2007/0275584 | A1 * | 11/2007 | Keating | 439/271 |
| 2011/0143566 | A1 * | 6/2011 | Nakamura | 439/271 |

* cited by examiner

*Primary Examiner* — Gary F. Paumen
(74) *Attorney, Agent, or Firm* — Christie, Parker & Hale, LLP

(57) ABSTRACT

A jumper cable plug for electrically connecting and physically engaging with a socket of the type used in the trucking industry is provided. The plug comprises a hollow cylindrical housing having a front end, a rear end, and a key extending from the front end toward the rear end. An annular grove is provided around the perimeter of the cylindrical housing, and a resilient seal is disposed in the annular grove.

11 Claims, 3 Drawing Sheets

ELECTRICAL CONNECTOR WITH MOISTURE RESISTANT SEAL

FIELD OF THE INVENTION

The present invention relates generally to jumper cable plugs of the type used to electrically connect a jumper cable between a trailer and tractor, truck, or another trailer to establish an electrical connection between the two, and more particularly to a jumper cable plug with a moisture resistant seal.

BACKGROUND

Some heavy duty trucks assemblies include, in combination, a tractor and one or more trailers joined in series to the rear portion of the tractor. The trailer usually is equipped with various electrical systems, such as brake lights, turning signal lights, and anti-lock braking systems. These electrical systems in the trailer are typically powered by the electrical system of the tractor. To establish an electrical connection between the tractor and the trailer, an electrical cable is connected between the rear wall of the tractor and the front wall of the trailer. Similar connections can also be made between trailers if the truck assembly includes more than one trailer.

Each of the electrical cables typically has a suitable plug configured to connect to a cooperating socket. The socket is generally mounted on the rear wall of a tractor cab or the front wall of a trailer. The socket usually has a plurality of male pins that mate with a plurality of female terminals in the plug. The male pins are typically soldered, welded or mechanically connected to the metallic ends of the wires in a sheathed cable. Likewise, the female terminals are soldered, welded, or mechanically connected to the metallic ends of another sheathed cable.

The basic structures of a jumper cable plug and its cooperating socket are the subject of SAE (Society of Automotive Engineers) standards, specifically SAE standard J560. The SAE standard J560 provides the minimum requirements for primary and auxiliary 7-pin jumper cable plugs and sockets (or, receptacle) for the tractor-trailer and converter dolly jumper cable systems. The standard also includes the test procedures, design and performance requirements. Standardizing the geometries of the socket and plug ensures that any trailer can be electrically connected to any tractor using any cable connection.

While the SAE standard J560 is popular in the U.S., the ISO (International Standardization Organization) has similar standards. For example, the ISO standard 1185 was developed in Europe for transferring electrical signals from a towing vehicle to a trailer through a 7-pin electrical connector. Other relevant ISO standards include, ISO standards 7638 and 12098. The SAE standard J560 and the ISO standards 1185, 7638, and 12098 are incorporated herein by reference.

The SAE and ISO standards only specify the minimum requirements for the connectors governed by their standards. In other words, particular connectors can differ from one another in features outside the SAE or ISO specifications.

Neither the SAE or ISO standards require that the plug and socket form a water-tight seal when connected. As a result, it has been found that the metallic connections in the plug and the socket remain exposed to moisture in the environment even when the plug and the socket are mated. Moisture enters into the socket cavity over time through the space between the mating plug and socket. If the moisture migrates to the mated male pins and female terminals, the moisture will cause the mated electrical terminals of the socket and plug to corrode, which overtime may degrade the electrical connection, or if severe enough, even cause a fault in one or more of the circuits of which the connection terminals are components. If the moisture that finds its way into the terminals of the mated plug and socket contain salt, such as the MgCl and/or NaCl salts used to de-ice roads during the winter season, the corrosion process is typically accelerated due to the presence of chloride ions.

Accordingly, there is a need for an improved jumper cable plug of the type used to electrically connect a jumper cable between a trailer and tractor, truck, or another trailer to establish an electrical connection between the two. More particularly, there is a need for an improved jumper cable plug with a moisture resistant seal that when mated to a cooperating socket provides improved moisture resistance to the electrical terminals of the plug and socket.

SUMMARY OF THE INVENTION

A jumper cable plug for electrically connecting and physically engaging with a socket cavity of a socket of the type used in the trucking industry is provided. As an example, the plug comprises a hollow cylindrical housing having a front end, a rear end, and a key extending from the front end toward the rear end. An annular grove is provided around the perimeter of the cylindrical housing, and a resilient seal is disposed in the annular grove.

DETAILED DESCRIPTION OF THE PREFERRED EMBODIMENTS

Figure 1:
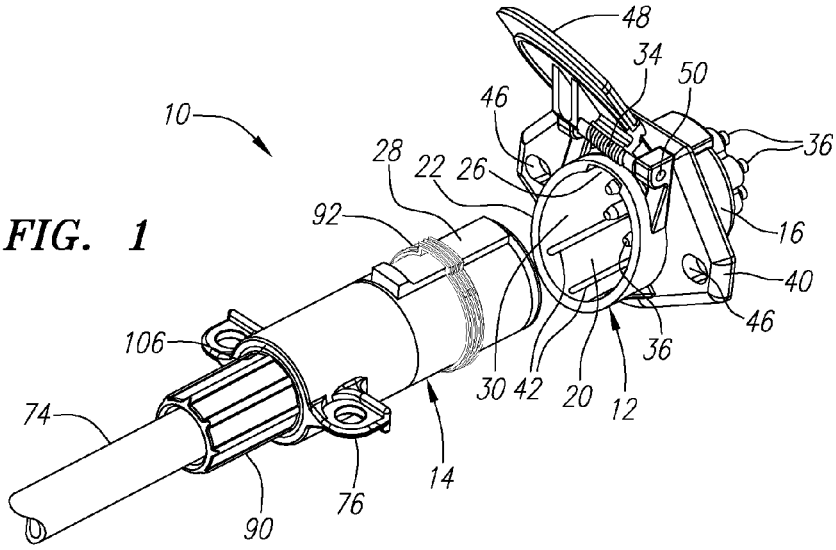
FIG. 1 is a perspective view of an exemplary electrical connector having a socket and a jumper cable plug shown an unmated position.

Embodiments will now be described with reference to the drawings. To facilitate the description, any reference numeral representing an element in one figure will represent the same element in any other figure. Further, in the following description, references to the front of a component shall generally mean the portion of the component that is closest to the mating end of the described plug or socket of which it forms a part. Similarly, references to the rear of a component shall generally mean the portion of the component that is away from the mating end of the described plug or socket of which it forms a part.

Exemplary jumper cable plugs are described in connection with FIGS. 1-10 below. The exemplary jumper cable plugs incorporate a number of distinct aspects. While these distinct aspects have all been incorporated into the jumper cable plugs described herein in various combinations, the scope of the present invention is not restricted to the jumper cable plugs described herein. Rather, the present invention is directed to each of the inventive features of the jumper cable plugs described below both individually as well as in various combinations. The present invention is also directed to the inventive features of the electrical connector, both individually as well as in various combination, described below.

FIG. 1 is a perspective view of an exemplary electrical connector 10 having a socket (or, receptacle) 12 and a jumper cable plug 14, which are shown in an unmated condition. The socket 12 and plug 14 of electrical connector 14 meet SAE standard J560. In other embodiments, the socket 12 and plug 14, may, for example, meet ISO standard 1185, 7638, or 12098, or other applicable standards.

Figure 2:
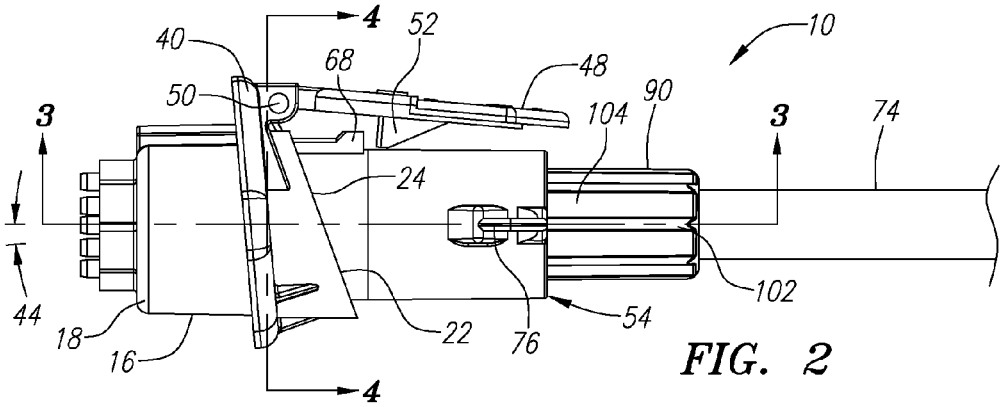
FIG. 2 is a side elevational view of the electrical connector of FIG. 1 showing the plug and socket in the mated position.

FIG. 2 is a plan view of the electrical connector 10 of FIG. 1 showing the socket 12 and plug 14 in a mated condition. Referring to both FIGS. 1 and 2, the socket 12 includes a cylindrical barrel 16 defining a generally cylindrical cavity 20 for receiving a mating plug 14. Cavity 20 is open at one end, the front end, and closed by end wall 18 at the rear end of barrel 16. The interior surface 30 of wall 22 defines a cavity 20 that includes a keyway 26 sized to receive a key 28 on the plug 14. Keyway 26 and key 28 cooperate to properly orient the plug 14 relative to the socket 12 when the plug 14 and the socket 12 are mated.

Figure 3:
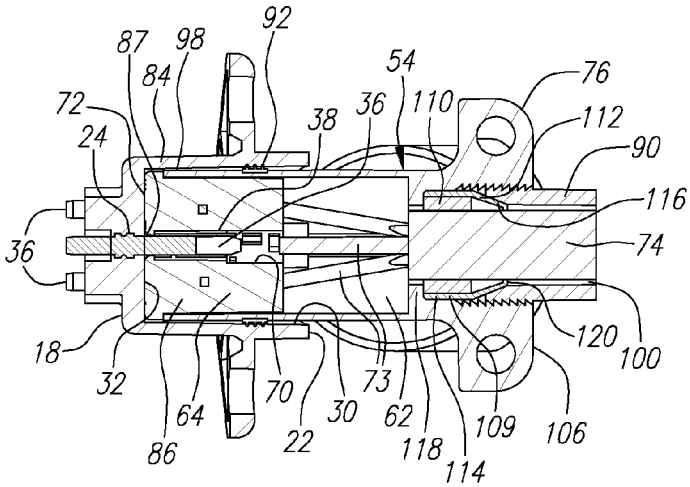
FIG. 3 is a cross-sectional view of the electrical connector of FIG. 2 taken along line 3-3.
Figure 4:
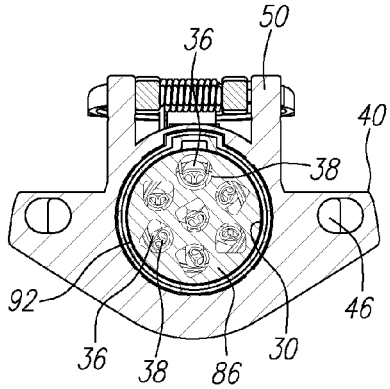
FIG. 4 is a cross-sectional view of the electrical connector of FIG. 2 taken along line 4-4.

Specific reference is now made to FIGS. 3 and 4, where FIG. 3 is a cross-sectional view of the electrical connector 10 of FIG. 2 taken along line 3-3 and FIG. 4 is a cross-sectional view of the electrical connector 10 of FIG. 2 taken along line 4-4. End wall 18 has an interior surface 32 that defines the rear end of cavity 20. Interior surface 32 is generally flat and cylindrical in shape. The end wall 32 has a plurality of metal male pins 36 extending therethrough. In the present embodiment, the socket 12 is made from injection molded plastic and the pins 36 are co-molded in the socket. In other words, the end wall 18 of socket 12 is directly injection molded around pins 36. Co-molding pins 36 into the end wall 18 in this manner helps ensure that moisture cannot enter into the socket cavity 20 through the rear of the socket 12. It also ensures a strong mechanical bond between pins 36 and end wall 18, thereby improving the durability of the socket 12.

The male pins 36 are double ended in that each includes a proximal end that extends into the cavity 20 for mating with the female terminals 38 of the plug 14 and a distal end that extends away from wall 18. Socket 12 is a QCS® socket from Phillips Industries. As a result, the rear end of socket 12 is designed to plug into another socket (not shown) configured to mount together with socket 12 on the wall of a tractor or trailer and having female connectors configured to accept the distal end of male pins 36. In this configuration, the socket 12 can be removed from the other socket by simply pulling it from the other socket. As a result, the socket 12 can be periodically replaced as use conditions demand without having to re-solder the wires from the sheathed cable to the distal end of male pins 36 to establish the necessary electrical connections between the conductors of the sheathed cable and the male pins 36.

In other embodiments, the distal ends of male pins 36 may be configured to be directly connected in a conventional manner to the electrical wires carried in a sheathed cable by soldering or mechanical connection as is known in the art.

The interior surface 30 of the socket 12 is preferably provided with a plurality of ribs 42. The ribs 42 are preferably elongated and extend in a direction corresponding to the longitudinal direction of the socket 12. Ribs 42 are provided on the bottom of socket barrel 16 to facilitate drainage of moisture or water from the cavity 20. Opposing ribs 42 are preferably provided on the top of barrel 42 to ensure that plug 14 remains properly spaced from interior surface 30 in all directions. In one embodiment, however, the plurality of ribs 42 are not evenly distributed around the interior surface 30 of wall 22. In a further embodiment, the lower portion of the interior surface 30 of the socket 12 has more ribs 42 than the upper portion of the interior surface 30. Yet in another embodiment, the plurality of ribs 42 are evenly spaced apart from each other on the interior surface 30 of the wall 22.

The socket 12 preferably includes a flange 40 which extends outward from the socket barrel 16 at its forward end. Referring to FIG. 2, the flange 40 preferably lies in a plane that forms an angle 44 between the normal of the flange 40 and the longitudinal axis of the socket 12. In other words, the plane of flange 40 and the longitudinal axis of the socket 12 are not perpendicular. With this configuration, when the socket 12 is mounted on a wall (not shown) of a tractor or a trailer with the flange 40 attached to the wall, the longitudinal axis of the socket 12 will slope slightly downward. The downward slope facilitates the drainage of water that may enter cavity 20 before the plug 14 is inserted into the cavity 20 for electrical connection, or when a conventional plug without seal 92 is mated with socket 12. In one embodiment, the angle 44 between the normal of the plan of flange 40 and the longitudinal direction of the socket 12 is 5°. In other embodiments, other angles may be selected.

A pair of mounting holes 46 are preferably formed through the flange 40 on opposing sides of the socket barrel 16. The mounting holes 46 can be used to facilitate the mounting of the socket 12 to the exterior wall of a tractor or a trailer.

The body of socket 12, including its barrel 16, end wall 18, and mounting flange 40, is preferably integrally formed from a hard material, for example, die cast metal, glass filled molded nylon, polyvinyl chloride material, or any other suitable materials.

The exterior wall (not shown) of a tractor or a trailer where the socket 12 is to be mounted is preferably provided with a pair of holes corresponding to the mounting holes 46. In addition, the tractor or trailer wall is also preferably provided with a central hole sized to receive the barrel 16 of the socket 12.

Optionally, a gasket (not shown) or other seating member having the same general shape as flange 40 may be used to mount with the socket 12 to the wall. The gasket or other seating member can be interposed between the wall of the tractor or trailer and the flange 40. A pair of nuts and bolts can be used to mount the gasket or other seating member and the socket 12 to the wall of the tractor or trailer.

Socket 12 may be provided with a hinged lid 48 to cover the opening of socket cavity 20. In the present embodiment, lid 48 is pivotally mounted between mounting bosses 50 provided on opposite sides of barrel 15 above cavity 20. A biasing member 34 is provided to bias the hinged lid 48 to a closed position in which lid 48 closes the opening of cavity 20. Thus, when plug 14 is not inserted in cavity 20 of socket 12, lid 48 will automatically close in the absence of any other force holding the lid 48 open. In the present embodiment, biasing member 34 is a torsional coil spring.

While the plug 14 is being mated to socket 12, the biasing member 34 biases the inside surface of the lid 48 towards the upper surface of the plug 14 locking tab 52 comes into contact with the top of plug 14. More specifically, in the absence of being held open by an operator, as plug 14 is inserted into cavity 20 of socket 12, the locking tab 52 will ride on the top surface of key 28. Locking tab 52 is positioned on the inside surface of lid 48 so that when plug 14 is fully mated with socket 12, locking tab 52 will act as a stop to prevent plug 14 from inadvertently becoming uncoupled from socket 12 during operation of, for example, a tractor-trailer combination. In particular, when the plug 14 is fully coupled to the socket 12, locking tab 52 is disposed rearward of the distal end 68 of key 28. As a result, locking tab 52 will stop plug 14 from uncoupling by blocking the distal end 68 of key 28 from moving more than a predetermined distance away from socket 12 in the absence of a user lifting lid 48 against the biasing force supplied by biasing member 34.

Preferably the distal end 68 of key 28 includes a raised protuberance to provide a surface against which locking tab 52 may operably act.

Figure 5:
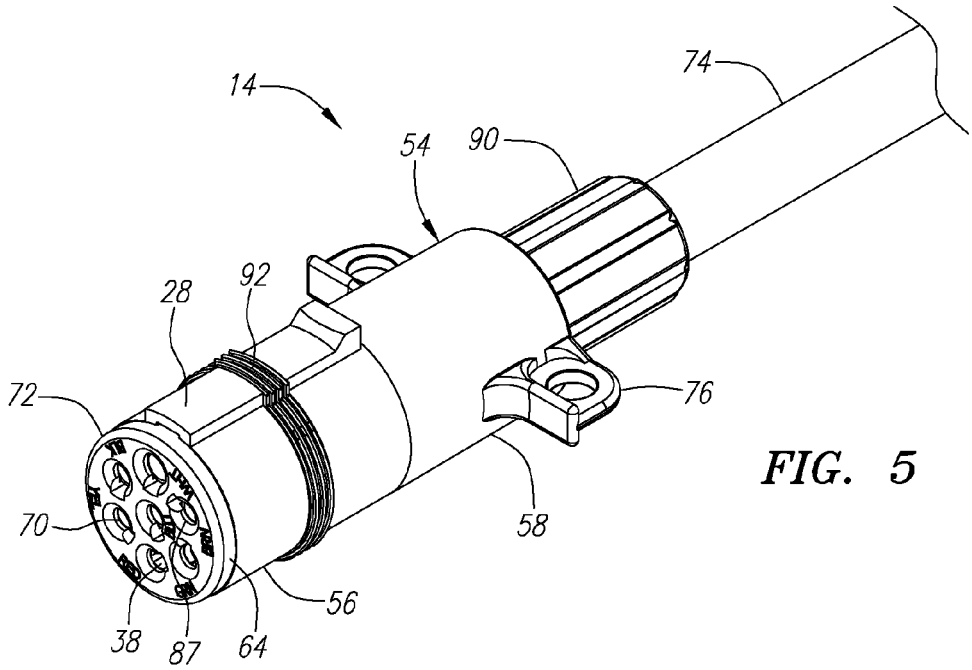
FIG. 5 is a perspective view of the jumper cable plug shown in FIG. 1.
Figure 6:
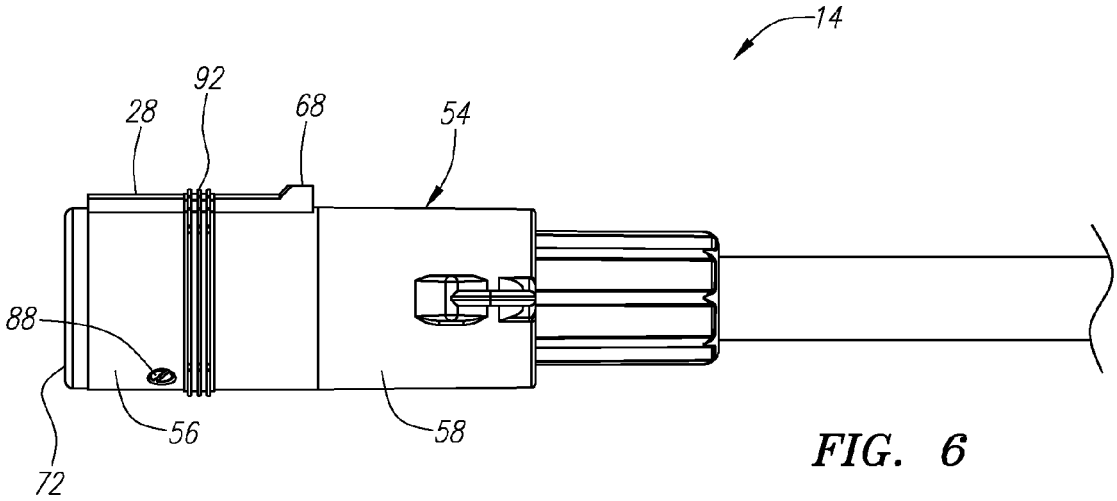
FIG. 6 is a side elevational view of the plug of FIG. 5.

Referring further to FIGS. 5-6, the plug 14 comprises a generally hollow plug housing 54 with openings at both the front and rear ends of the housing 14, pull tabs 76 disposed on opposite sides of housing 54 adjacent the rear end of housing 14, a terminal holder 64 disposed in the opening on the front end of plug housing 54, and a cable guard 90 disposed in the opening on the rear end of the plug housing.

Figure 7:
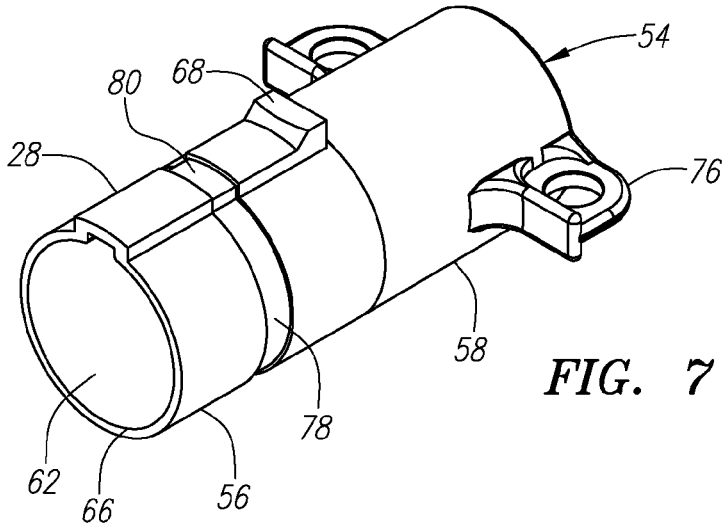
FIG. 7 is a perspective view of one embodiment of a plug housing of the jumper cable plug of FIG. 5.

Plug housing 54 comprises a generally hollow cylindrical housing 54 having a front portion 56 and a rear portion 58 and defining an interior space 62. FIG. 7 is a perspective view of one embodiment of the plug housing 54 of FIG. 5.

In the present embodiment, the plug housing 54 and pull tabs 76 are preferably integrally molded from a tough nylon material or other suitable material.

The terminal holder 64 includes a main body 86 removeably disposed with the front portion 56 of plug housing 54 and a circular end wall 72 disposed adjacent the forward end of the plug housing 54. The terminal holder 64 is preferably injection molded from a plastic material such as nylon. The terminal holder 64 is preferably shaped to generally close the opening at the front end of the plug housing 54. The end wall 72 preferably has a diameter that is about the same as the exterior diameter of the cylindrical plug housing 54 while the main body 86 of the terminal holder 64 is preferably has a diameter that is about the same as (or slightly smaller than) the interior diameter of the plug housing 54. Therefore, the main body 86 of the terminal holder 64 can be properly inserted into the interior space 62 of the plug housing 54 while the end wall 72 will abut the front end of the housing 54.

A screw 88 (shown in FIG. 6) can be used to fix the terminal holder 64 in a stable position within the front portion 56 of housing 54. To facilitate the use of screw 88 to attach terminal holder 64 to housing 54, a hole for receiving screw 88 through the wall of the plug housing 54 may be molded directly in the wall of the front portion 56 of the plug housing 54. Alternatively, the hole may be drilled after the housing 54 is formed.

The terminal holder 64 preferably includes a plurality of elongated channels 70 that extend through the terminal holder 64. Channels 70 are formed in a pattern matching the pin pattern of male pins 36 in the corresponding sockets, such as socket 12, to which plug 14 is designed to mate. Each channel 70 is sized to receive a metallic female terminal 38 therein from the rear end of terminal holder 64. Preferably the forward ends of the channels include an area for receiving a spring tab of a female terminal 38 as is known in the art. In this way, a terminal 38 can be inserted from the rear of terminal holder 64, but once fully inserted, it will be blocked from leaving channel 70.

Further, as best seen in FIGS. 3 and 5, each channel 70 includes a stop 87 provided in the end wall 72 portion of the channel 70. Stops 87 are provided to prevent the terminals 38 from being pulled through the front side of terminal holder 64 when plug 14 is uncoupled from socket 12, or other corresponding socket, in the conventional manner or as a result of an inadvertent "drive off" Given that plug 14 is repeatedly coupled and uncoupled throughout its life, the stress relief function provided by stops 87 help to extend the life expectancy of plug 14 and/or the frequency of maintenance required related to the female terminals 38.

Female terminals 38 are attached to the conductors in coated wires 73 of cable 74 in a conventional manner, such as by mechanically crimping female terminals 38 to the ends of the wire conductors in the coated wires 73. After terminals 38 are attached to the ends of coated wires 73, each terminal 73 is inserted into its corresponding channel in terminal holder 64 based on the color of the wire 73 attached to the terminal 38 as is conventional in the art. As described above, upon insertion of terminals 38 into their corresponding channel 70, a tab on terminals 38 prevents the terminal from being withdrawn from the channel as is conventional in the art.

In one embodiment, the cable guard 90 is used to provide stress relief to the ends of the coated wires 73 that are mated with terminals 38 and thereby prevent accidental cable pull-out of cable 40 from the rear end of plug 14.

In the illustrated embodiment, cable guard 90 includes a cylindrical hole 100 extending longitudinally therethrough. Cable 74 extends through the cylindrical hole 100 of cable guard 90. The exterior surface of the cable guard 90 is longitudinally castellated with ridges 102 and recesses 104 for improved gripping. The internal surface of rear end 106 of plug housing 54 is threaded. Mating threads are provided on the external surface of the forward end of cable guard 90. Thus, cable guard 90 may be removably threaded into the rear end of plug housing 54.

A rubber grommet 110 is positioned about the forward end of the sheathed portion of cable 74. Cable clamp 109 is provided about rubber grommet 110. Cable clamp 109 includes a plurality of tapered clamping fingers 112 extending rearwards from an annular ring portion 114 at the forward end of the cable clamp 109. The distal ends of clamping members 112 include a gripping edge 120 that extends radially inward toward cable 74 in a direction that is generally transverse to the longitudinal axis of the cable 74. As explained more fully below, gripping edges 120 dig into the sheath of cable 74, thereby preventing cable 74 from being accidentally pulled out of the rear of plug 14.

The annular ring portion 114 of the cable clamp 109 abuts a stop 118 which extends radially inward from the wall of plug housing 54. As a result, when cable guard 90 is screwed into plug housing 54, the tapered clamping fingers 112 become interposed between beveled surface 116 at the forward end of cable guard 90 and cable 74. Further, as cable guard 90 is threaded into plug housing 54, the annular ring portion 114 of cable clamp 109 is prevented from moving forward in plug housing 54 beyond stop 118. Thus, as cable guard 90 is continued to be screwed into the rear end of cable housing 54, the cable guard 90 will translate in a forward direction toward stop 118. As a result, the beveled surface 116 will press the tapered clamping fingers 112 radially inward toward the sheath of cable 74 and their respective gripping edges 120 will bite into the surface of the cable 74 to prevent the cable 74 from moving rearward.

The longitudinal key 28 formed on the front portion 56 of plug housing 54 preferably extends from the front end 66 toward the rear portion 58 of the plug housing 54. The key 28 preferably has a distal end 68 that is disposed outside of cavity 20 of socket 12 when plug 14 is fully mated with socket 12. The distal end 68 preferably comprises a protuberance that has a larger cross-sectional thickness than the rest part of the key 28. As noted above, distal end 68 is configured to cooperate with a locking tab 52 of a mating socket 20 to prevent accidental pull-out of plug 14 during operation.

The key 28 cooperates with the keyway 26 formed in the sleeve 18 of the socket 12 to assure that the plug 14 and the socket 12 have the correct angular relation to each other when they are mated together. The key 28 is preferably integrally formed with the plug housing 54.

In the present embodiment, rear portion 58 of the plug housing 54 includes a pair of pull tabs 76 that extend outwardly from opposing sides of the plug housing 54 to facilitate removal of the plug 14 from socket 12.

Referring to FIG. 7, the front portion 56 of plug housing 54 preferably has an annular groove 78 that surrounds the plug housing 54. The annular groove 78 should be located so that when plug 14 is mated with a corresponding socket, such as socket 12, the groove 78 will be fully received within the socket cavity. The annular groove 78 is preferably formed in plug housing 54 rearward of screw 88. In other words, the screw 88 is preferably interposed between the front end 66 of the plug housing 56 and the annular groove 78. In one embodiment, the annular groove 78 is located in approximately the middle of the key 28. In other embodiments, the annular groove 78 may be formed in other locations.

As best seen from FIG. 7, annular groove 78 extends around the entire circumference of plug housing 54, and includes a portion 80 formed on the key 28. In other words, annular groove 78 preferably tracks the outer profile of the plug housing 54.

The annular groove 78 preferably has a width in the range of approximately 0.2 inches to 0.25 inches. However, other dimensions for the annular groove 78 may also be employed.

The annular groove 78 is preferably molded into the housing 54. However, in some embodiments, it may be desirable to machine annular groove 78 into the plug housing 54.

Referring to FIG. 1, the plug 14 comprises a resilient seal ring 92 disposed about plug housing 54 in the annular groove 78. The resilient seal ring 92 preferably has a width corresponding to that groove 78 so that it may be received therein. Accordingly, the resilient seal ring 92 preferably has a contour that corresponds to the cross-sectional profile of the annular groove 78 around the plug housing 54 so that the seal ring 92 can be tightly fitted around plug housing 54 within annular groove 78.

Figure 9:
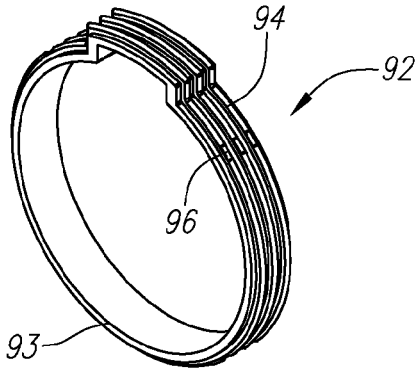
FIG. 9 is a perspective view of one embodiment of a seal ring.
Figure 10:
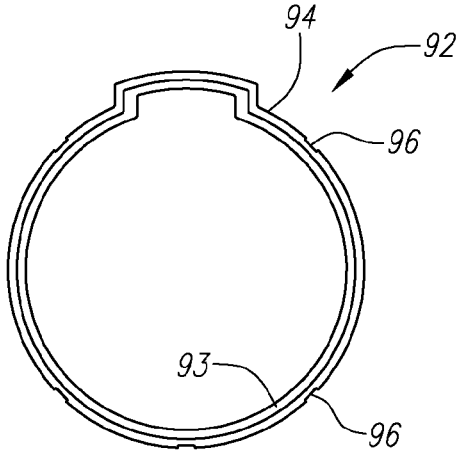
FIG. 10 is a plan view of the seal ring of FIG. 9.

Referring to FIGS. 9-10, the resilient seal ring 92 includes a base portion 93, which seats in the annular groove 78 and a plurality of flexible ribs 94 integrally formed therewith. The flexible ribs 94 extend radially outward from the base 93 about its circumference. In one embodiment, three flexible ribs 94 are provided. In other embodiments, other forms of seal rings may be employed.

The seal ring 92 is preferably made from a rubber material. In one embodiment, the rubber material is EPDM rubber. In another embodiment, the rubber material is silicone rubber. Other resilient materials can also be used to make the resilient seal ring 92.

Although not required, a plurality of relief cuts 96 may be formed in the ribs 94. Relief cuts 96 are positioned and sized to align with and receive ribs 42 when plug 14 and socket 12 are mated.

As noted above, the annular groove 78 is located so that when plug 14 is mated with a corresponding socket, such as socket 12, the groove 78 will be fully received within the socket cavity. As a result, as shown in FIGS. 2-4, when plug 14 is fully engaged with socket 12, resilient seal ring 92 will be positioned within the cavity 20 so that it is interposed between plug housing 14 and the interior surface 30 of wall 22.

When the plug 14 is engaged with the socket 12 by inserting it into the cavity 20 of the socket 12, a sealed internal volume 98, which is closed by the resilient seal ring 92 is formed. Because the seal ring 92 (including ribs 94) is made of a generally resilient material, the seal ring 92 conforms to the profile of the interior surface 30 of wall 22 to form a water-resistant, if not a water-tight seal. Moreover, because the annular groove 78 is preferably formed rearward of screw 88, the sealed internal volume 98 also includes the area where the screw 88 is inserted through plug housing 54. Therefore, the female terminals 38 of plug 14 and the male pins 36 of the mating socket, such as socket 12, will be protected from moisture in the environment, and thus the potential for corrosion that the presence of moisture can cause, when the plug is mating with a cooperating socket.

When the plug 14 is inserted into the cavity 20 of the socket 12, or another mating socket, the ribs 94 of the resilient seal ring 92 will be tilted rearward toward the rear portion 58 of housing 54 due to the frictional force between the ribs 94 and the interior surface 30 of the socket 12. As a result, it will be easier for any residual moisture that may be within the sealed internal volume 98 to exit than for moisture from the environment to get in. In addition, when the plug 14 is pushed into the cavity 20, the air pressure within the sealed internal volume 98 will be higher than the air pressure outside the sealed internal volume 98. This will also help prevent moisture from the atmosphere from getting into the sealed internal volume 98.

As those skilled in the art will appreciate, plug 94 will need to be able to mate with any type of socket meeting the same standard against which plug 14 is constructed, including sockets made by a host of different manufacturers. The jumper cable plugs 14 of the present patent document are capable of forming a water-resistant, if not a water-tight seal with any such corresponding socket. Because the seal ring 92 (including the ribs 94) is made out of a generally resilient material, seal ring 92 will conform to the interior surface 30 of wall 22 of a socket 12 thereby forming a water-resistant, if not a water tight seal in a variety of plug 14 and socket 12 combinations, including, for example: (1) the resilient seal ring 92 of plug 14 includes relief cuts 96 in ribs 94 and the socket 12 has corresponding ribs 42 provided on interior surface 30 of wall 22; (2) the resilient seal ring 92 of plug 14 has relief cuts 96 in ribs 94, but the socket 12 does not have any corresponding ribs 42 on interior surface 30 of wall 22; (3) the resilient seal ring 92 of plug 14 does not include any relief cuts 96 in ribs 94, but the socket 12 has ribs 42 formed on the interior surface 30 of wall 22; and (4) the resilient seal ring 92 of plug 14 does not include any relief cuts 96 in ribs 94 and the socket 12 does not have any ribs 42 on interior surface 30 of wall 22.

Referring to FIGS. 9 and 10, in one embodiment, the resilient seal ring 92 is preferably formed separate from the plug housing 54 and then placed over the plug housing in the annular groove 78. To mitigate the likelihood that seal 92 will be displaced during repeated coupling and uncoupling operations, seal 92 is preferably bonded within annular groove 78 of plug housing 54 using a suitable adhesive.

Instead of being adhesively bonded to plug housing 54, seal ring 92 may be over-molded onto the annular groove portion of the plug housing. Alternatively, if a material with a sufficient glass transition temperature is used, the seal ring 98 may be co-molded with the plug housing so that the plug housing is injection molded around the seal ring. In this way, the seal ring may provided with features which improve the mechanical bonding between the seal ring 98 and plug housing 54

Figure 8:
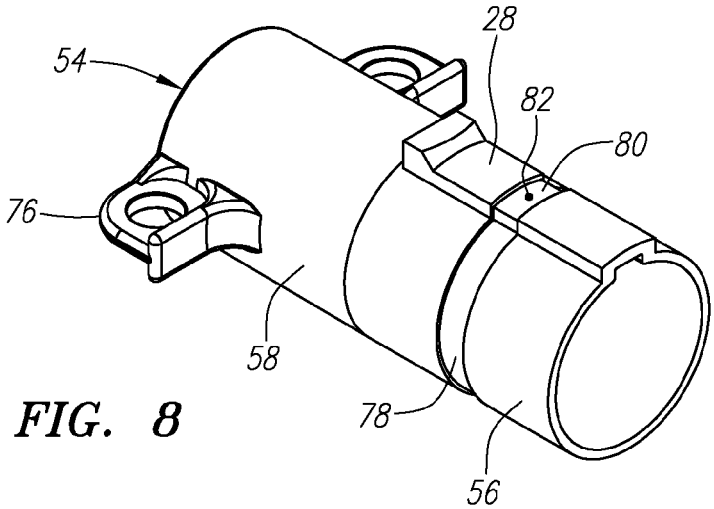
FIG. 8 is a perspective view of another embodiment of a plug housing.

FIG. 8 is a perspective view of another embodiment of the plug housing 54 for use in plug 14. In this embodiment, a protuberances 82 is formed at approximately the middle of the portion 80 of annular groove 78 formed on key 28. The protuberance 82 is used to position and help retain seal 92 within annular groove 78. Accordingly, in this embodiment, seal ring 92 would include a corresponding recess for receiving protuberance 82.

Although in the illustrated embodiment, protuberance 82 is located on portion 82 of annular groove 78, in other embodiments, protuberance 82 may be located in other positions around the perimeter of annular groove 78. Further, more than one protuberance 82 and corresponding recesses in seal 92 may be employed.

While embodiments of the invention presented above have been shown and described as comprising a plug with female terminals so that the mating socket has male pins, it is within the scope of the invention for the electrical terminals to be reversed so that the plug has male pins and the mating socket has female terminals. If the plug 14 is constructed to comply with a particular SAE or ISO standard, then the plug 14 will mate with any socket that has also been constructed according to the standard. Thus, the plug 14 of the present patent document will provided water-resistant, if not water-tight seals when coupled to sockets within an existing fleet of trucks or trailers.

Although the invention has been described with reference to preferred embodiments and specific examples, those of ordinary skill in the art will readily appreciate that many modifications and adaptations of the invention are possible without departure from the spirit and scope of the invention as claimed hereinafter.

What is claimed is:

1. A jumper cable plug for electrically connecting and physically engaging with a socket cavity of a socket of a type used in the trucking industry, the plug comprising:

a hollow cylindrical plug housing having a front end, a rear end, and a key extending from the front end toward the rear end;

an annular groove around a perimeter of the cylindrical plug housing and having a protuberance aligned with the key; and a resilient seal ring disposed in the annular groove.

2. The plug according to claim 1, wherein when the plug is engaged with the socket by inserting the plug into the cavity of the socket, a closed internal volume confined by the seal ring is formed.

3. The plug according to claim 1, wherein the annular groove is positioned so that the seal ring is completely positioned within the cavity of the socket when the plug is engaged with the socket.

4. The plug according to claim 1, wherein the front end is sized to receive a terminal holder having a plurality of holes for accepting a plurality of female terminals.

5. The plug according to claim 4, wherein the plurality of holes are disposed in an array conforming to SAE Standard J560.

6. The plug according to claim 1, wherein the resilient seal ring has a plurality of ribs.

7. The plug according to claim 6, wherein the number of the plurality of ribs is three.

8. The plug according to claim 1, wherein the resilient seal ring is made from a rubber material.

9. The plug according to claim 8, wherein the rubber material is selected from the group of EPDM rubber and silicone rubber.

10. A jumper cable plug for electrically connecting an physically engaging with a socket cavity of a socket of a type used in the trucking industry, the plug comprising:

a hollow cylindrical plug housing having a front end, a rear end, and a key extending from the front end toward the rear end;

an annular groove around a perimeter of the cylindrical plug housing; and a resilient seal ring disposed in the annular groove, wherein the annular groove tracks a cross-sectional profile of the housing and includes a portion extending about the key.

11. A jumper cable plug for electrically connecting an physically engaging with a socket cavity of a socket of a type used in the trucking industry, the plug comprising:

a hollow cylindrical plug housing having a front end, a rear end, and a key extending from the front end toward the rear end;

an annular groove around a perimeter of the cylindrical plug housing; and a resilient seal ring disposed in the annular groove, wherein a lock is formed at approximately a middle portion of a cut of the key to facilitate attachment of the seal ring.

* * * * *

UNITED STATES PATENT AND TRADEMARK OFFICE

CERTIFICATE OF CORRECTION

PATENT NO. : 8,192,216 B1
APPLICATION NO. : 13/022629
DATED : June 5, 2012
INVENTOR(S) : Oscar A. Puluc et al.

It is certified that error appears in the above-identified patent and that said Letters Patent is hereby corrected as shown below:

On the Title Page

| | |
|---|---|
| Item [57] Abstract, line 5 | Delete "grove"<br>Insert -- groove -- |
| Column 10, Claim 10, line 20 | Delete "an"<br>Insert -- and -- |
| Column 10, Claim 11, line 32 | Delete "an"<br>Insert -- and -- |

Signed and Sealed this
Twenty-fifth Day of December, 2012

David J. Kappos

David J. Kappos
*Director of the United States Patent and Trademark Office*